US009573385B2

(12) United States Patent
Moench et al.

(10) Patent No.: US 9,573,385 B2
(45) Date of Patent: Feb. 21, 2017

(54) PRINTING APPARATUS AND METHOD FOR CONTROLLING A PRINTING APPARATUS

(75) Inventors: Holger Moench, Vaals (NL); Stephan Gronenborn, Aachen (DE); Armand Pruijmboom, Wijchen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 96 days.

(21) Appl. No.: 13/578,712

(22) PCT Filed: Mar. 16, 2011

(86) PCT No.: PCT/IB2011/051096

§ 371 (c)(1),
(2), (4) Date: Aug. 13, 2012

(87) PCT Pub. No.: WO2011/114296

PCT Pub. Date: Sep. 22, 2011

(65) Prior Publication Data

US 2013/0176375 A1 Jul. 11, 2013

(30) Foreign Application Priority Data

Mar. 18, 2010 (EP) ..... 10156943

(51) Int. Cl.
*B41J 2/45* (2006.01)
*B41J 2/455* (2006.01)
(Continued)

(52) U.S. Cl.
CPC *B41J 2/48* (2013.01); *B41J 2/447* (2013.01); *B41J 2/45* (2013.01); *B41J 2/451* (2013.01);
(Continued)

(58) Field of Classification Search
CPC ..... B41J 2/45; B41J 2/455; B41J 2/47
(Continued)

(56) References Cited

U.S. PATENT DOCUMENTS 4,863,538 A 9/1989 Deckard
4,870,652 A 9/1989 Thornton
(Continued)

FOREIGN PATENT DOCUMENTS

CA 2225304 A1 6/1998
CN 1659479 A 8/2005
(Continued)

OTHER PUBLICATIONS

Nakayama et al: "780nm VCSELs for Home Networks and Printers"; 2004 Electronic Components and Technology Conference, 1EEE, vol. 2, Jun. 2004, pp. 1371-1375.

*Primary Examiner* — Kristal Feggins
*Assistant Examiner* — Kendrick Liu

(57) ABSTRACT

The invention relates to a laser based printing apparatus (100) using laser light sources (111, 112, 113, 402, 404, 406, 604, 606, 808, 810) for supplying energy to a target object (120) to form an image. The printing apparatus (100) comprises a laser light source arrangement (110, 400, 600) comprising a plurality of laser light sources (111, 112, 113, 402, 404, 406, 604, 606, 808, 810) arranged such that laser beams (114, 410, 805, 806) of the laser light sources (111, 112, 113, 402, 404, 406, 604, 606, 808, 810) intersect a surface (121) of a target object (120) at different target points (123, 24, 125, 412, 414, 416, 616, 610, 802) along a moving direction (122), a transport mechanism (130) for moving the target object (120) and the laser light sources (111, 12, 113, 402, 404, 406, 604, 606, 808, 810) relatively to each other in the moving 10 direction (122) and a controlling arrangement (140), which is realized to control the laser light sources (111, 112, 113, 402, 404, 406, 604, 606, 808, 810) and/or the transport mechanism (130) based on image data (150) in such a way, that the energy level of a target point (123, 124, 125, 412, 414, 416, 616, 610, 802) is stepwise increased by irradiation of at least two different laser light
(Continued)

sources along the moving direction (122). The invention also describes a method for controlling such a laser based printing apparatus (100).

15 Claims, 5 Drawing Sheets

(51) Int. Cl.
*B41J 2/475* (2006.01)
*B41J 2/48* (2006.01)
*B41J 2/447* (2006.01)

(52) U.S. Cl.
CPC ..... *B41J 2/455* (2013.01); *B41J 2/475* (2013.01); *B41J 2/4753* (2013.01)

(58) Field of Classification Search
USPC ..... 347/224, 225, 233, 238, 251, 262, 264
See application file for complete search history.

(56) References Cited

U.S. PATENT DOCUMENTS

| | | | | | |
|---|---|---|---|---|---|
| 5,166,999 | A * | 11/1992 | Rees et al. | ..... | 385/120 |
| 5,461,413 | A * | 10/1995 | Askinazi et al. | ..... | 347/243 |
| 5,879,864 | A * | 3/1999 | Yokokawa | ..... | 430/350 |
| 5,940,113 | A * | 8/1999 | Wilson | ..... | 347/238 |
| 6,396,793 | B1 | 5/2002 | Brewen | | |
| 7,002,613 | B2 | 2/2006 | Beier et al. | | |
| 2003/0214571 | A1 | 11/2003 | Ishikawa et al. | | |
| 2004/0046860 | A1 | 3/2004 | Beier et al. | | |
| 2005/0068411 | A1 | 3/2005 | Amm et al. | | |
| 2005/0174419 | A1 * | 8/2005 | Kitazawa | ..... | B41J 2/447 347/118 |
| 2006/0164499 | A1 * | 7/2006 | Yaji | ..... | G03G 15/0415 347/135 |
| 2007/0152725 | A1 | 7/2007 | Pham | | |
| 2007/0268356 | A1 | 11/2007 | Murakami et al. | | |
| 2008/0192107 | A1 * | 8/2008 | Griffin et al. | ..... | 347/238 |
| 2009/0016753 | A1 | 1/2009 | Zaima | | |
| 2009/0086176 | A1 * | 4/2009 | Meisburger | ..... | 355/50 |

FOREIGN PATENT DOCUMENTS

| | | | |
|---|---|---|---|
| EP | 1241013 | A1 | 9/2002 |
| EP | 1366920 | A1 | 12/2003 |
| JP | 61182966 | A | 8/1986 |
| JP | 1026468 | A | 1/1989 |
| JP | 1502890 | A | 10/1989 |
| JP | H0612713 | A | 5/1994 |
| JP | 6277983 | A | 10/1994 |
| JP | 8336992 | A | 12/1996 |
| JP | 2004114508 | A | 4/2004 |
| JP | 2004216628 | A | 8/2004 |
| JP | 2007109929 | A | 4/2007 |
| WO | 2004019079 | A2 | 3/2004 |

* cited by examiner

PRINTING APPARATUS AND METHOD FOR CONTROLLING A PRINTING APPARATUS

FIELD OF THE INVENTION

The invention relates to a laser based printing apparatus using laser light sources for supplying energy to a target object to form an image, comprising a laser light source arrangement comprising a plurality of laser light sources, a transport mechanism and a controlling arrangement connected to the laser light arrangement and the transport mechanism. The invention also describes a method for controlling a laser based printing apparatus. Thereby, the terminus "printing" is used in the context of this invention for producing an image independent whether the resulting image is two or three-dimensional. There are different indirect and direct printing techniques. An example for an indirect technique is the irradiating of an electrically charged target object, e.g. a revolving photosensitive drum or belt, with laser beams according to image data and thereby changing its electrical properties. The target object's charged areas then electrostatically pick up for example ink particles, which next are printed to the final printing medium, e.g. paper. An example for a direct printing technique is the irradiating i.e. heating of a target object which in fact is also the final printing medium. This technique can be used to heat up a thermo-activated ink or during laser sintering the laser light sources directly melting small particles of powdered material into a three-dimensional image.

BACKGROUND OF THE INVENTION

Laser printing is of increasing interest for many applications including printing on packages, offset plate writing and laser sintering of three-dimensional structures.

There are references to laser printing with lasers irradiating a target object and changing the electrical properties or simply heating the target object. For example, United States patent US 2004/0046860 A1 discloses a device and a corresponding method for inputting energy to a printing-ink carrier comprising a plurality of individual controllable laser light sources.

The easy controllability and the cost-effectiveness of small laser light sources, such as Vertical Cavity Surface Emitting Laser (VCSEL) arrays makes them an ideal candidate for the use in a printing apparatus. Unfortunately their power density is relatively low. On the other hand, for fast moving target objects (e.g. paper, goods) in a printing process the period in time for the laser irradiation is very limited. Therefore most often a comparatively high laser power density would be required.

One possible solution may be to superimpose the beams of several laser light sources at one point of the target object. However, this requires a specific optical arrangement of the laser light sources and/or the use of additional lenses. Geometrical restrictions limit the number of lasers beams, which can be superimposed and there are general limitation in terms of solid angles and Etendue. A further disadvantage is that the lasers beams coming from the sides have non-perpendicular incidence angle and therefore can be absorbed differently and can show a distorted illumination pattern.

It is therefore an object of the present invention to provide an apparatus and a method to form an image, which allows for supplying sufficient energy to target objects in an economical and straightforward way without the necessity of complex optical arrangements.

SUMMARY OF THE INVENTION

The object of the invention is achieved by a printing apparatus according to claim 1 and by a method according to claim 11.

The printing apparatus according to the invention comprises a laser light source arrangement comprising a plurality of laser light sources arranged such that laser beams of the laser light sources intersect the surface of a target object at different target points along a moving direction. The printing apparatus further comprises a transport mechanism for moving the target object and the laser light sources relatively to each other in a moving direction to get target object and laser light sources in a proper position for the irradiation. In the context of the invention the term "target object" is used for objects, which are irradiated by the laser light sources in order to directly or indirectly printing a target image. Indirect means that the target object after being irradiated contains only a representation of parts of the complete image, which then has to be transformed into the target image through further processing steps. The term "target point" in the context of the invention is used for a point of the target object irradiated by the laser light sources during a printing process. Each target point corresponds to an image point of the target image. In the context of the invention "irradiation" is to be understood to mean the optical power radiated as electromagnetic radiation by the laser light sources.

Depending on which kind of target object is handled it can be advantageous to move only the target object whereas the laser light sources are at rest or vice versa or to move both the target object and the laser light sources. Preferably any kind of motion, i.e. change of the position and/or orientation, of both the laser light sources and the target objects may be considered, e.g. motions along a line or a curve or also rotations, thereby defining a moving direction.

The transport mechanism and/or the laser light source arrangement comprising the laser light sources are connected to a controlling arrangement. The controlling arrangement is realized to control the laser light sources of the laser light source arrangement and/or the transport mechanism based on image data in such a way, that the energy level of a target point is stepwise increased to a desired amount needed for printing the target image by irradiation of at least two different laser light sources along the moving direction. For this purpose the controlling arrangement may comprise a power control module for controlling the output power of the laser light sources.

Accordingly, in a method for controlling such printing apparatus the target object and the laser light sources are moved relatively to each other in such a way, that laser beams of the laser light sources intersect the surface of the target object at different target points along a moving direction and the target object is irradiated based on image data in such a way, that the energy level of a target point is stepwise increased by irradiation of at least two different laser light sources along the moving direction. By increasing the energy level of the target point to the desired amount, hence referred to as "final energy level", those physical reactions of the target object are triggered, which are necessary for the further printing process. The final energy level depends on the texture of the target object and the applied printing technique as for instance changing electrical properties or simply heating.

In order to increase the energy level of the target points the controlling arrangement controls the transport mechanism and/or the laser light sources in such a way that the target object and/or the laser light sources are moved to proper positions and the laser light sources irradiate the target points again before cooling and thermal diffusion of the target object decreases the energy level of the target points significantly. Thereby, the controlling arrangement regulates the irradiation intensity in accordance with the motion of the target object and/or the laser light sources, the texture of the target object and the applied printing technique in such a way, that the target points are irradiated sufficiently. Preferably target objects with low thermal conductivity (e.g. paper, plastics) may be applied. Since each target point is irradiated multiple times, a single laser light source not necessarily irradiates the target point above the threshold energy. Therefore the printing apparatus may be used advantageously in fast or high-speed production processes. For the same reason, less powerful and therefore more cost-effective laser light sources may be applied, overcoming power limitations by multiple irradiation. Since complex optical arrangements of lasers and/or the usage of additional lenses are not needed, the invention may allow for a flexible and simple system design. The invention may also advantageously be applied for printing applications where geometrical restrictions or disproportional complexity and costs hinder the deployment of complex optical arrangements and/or additional lenses. Furthermore the energy level at the target point may be increased even beyond the limits of optical super position. This may be advantageously used for applications where high power density of a laser beam is required for printing and the target object features a rather low thermal conductivity.

The dependent claims and the following description disclose particularly advantageous embodiments and features of the invention. Features of the various embodiments may be combined to give further embodiments as appropriate.

In a preferred embodiment of the printing apparatus, the controlling arrangement is realized in such a way that the controlling of the laser light sources is synchronised with the movement of the target object. Therefore the controlling arrangement requires the position data of the target object in accordance with the laser light sources. The controlling arrangement principally can derive the position data from the movements performed by the transport mechanism. Thereby velocity and moving direction of the target object and/or laser light sources are considered. Position data can also be gained by an additional position sensor, which is measuring the position of the target object in accordance with the laser light sources. The sensor can be part of the laser light source arrangement. Thus the controlling of the transport mechanism by the controlling arrangement can be obsolete, since the laser light sources and/or the target object can be moved continuously and independently from image data. In this case printing can be done based on image data and position data gained from the position sensor.

In an advantageous embodiment, the controlling arrangement of the printing apparatus may be realized in such a way that only a subset of the laser light sources are individually controlled based on the image data, i.e. a part of the laser light sources can be addressed separately. In an advantageous usage of this feature the controlling arrangement may control the laser light sources in such a way, that in order to operate more energy efficiently only areas of the target object are irradiated where it is needed.

For the printing process the controlling arrangement is receiving image data via an appropriate interface. The image data is either of a format already suitable for the controlling arrangement or of one of the diverse standard image formats (e.g. CAD files, Adobe PostScript, HP Printer Command Language) and the controlling arrangement converts them into an appropriate internal data format prior to printing.

The printing apparatus may be designed that the transport mechanism is moving the target object and/or the laser light sources such that the same target point is irradiated by the same laser light source several times. However, in a further development of the printing apparatus the transport mechanism moves the target object and the laser light sources relative to each other such that each laser light source irradiates the same target point only once. In this way, little or no backward movements have to be performed by the transport mechanism. Therefore, this feature may advantageously be used for high speed printing production.

In a preferred embodiment of the printing apparatus, the controlling arrangement controls the laser light sources in such a way that the laser light sources operate at a defined power operating point, which is a fraction of a maximum output power of the laser light sources. The operating point is the amount of output power supplied by the laser light sources during standard printing operations in order to achieve adequate irradiation of the target object for a good printing quality. Preferably the controlling arrangement is realized in such a way, that it converts a desired value of laser light exposure based on the image data into an adequate operating point for the laser light sources, dependent on the texture of the applied target object. The value of laser light exposure may be adjusted according to the texture of the applied target object and entered for example by the printing apparatus manufacturer. This feature allows for more flexibility at the usage of the printing apparatus.

In a preferred method for controlling the printing apparatus, the deficit or missing output power of failing laser light sources is compensated by driving other properly working or fully functional laser light sources, which irradiate the same target point during a printing process ("corresponding laser light sources"), at an increased level of power according to defined compensation rules. Preferably the operating point of the laser light sources may be defined as the "(n−1/n)th part" of the maximum output power, where 'n' is the number of corresponding laser light sources. A failing laser light source can then be compensated by driving the corresponding laser light sources at maximum power.

In a further preferred embodiment of the printing apparatus, laser light sources are arranged in such a way that an area of the target object irradiated by one of the laser light sources does not interleave a neighbouring area irradiated by another laser light source. Depending on the lenses used, the irradiated area of laser diodes most commonly exhibits a circular or elliptical shape. Interleaving of such irradiated areas at the target object may lead to overheating, i.e. target points get significantly more energy then they ought to during the printing process. Distortion or even destroying of the target image can be the consequence. Therefore this feature may advantageously be used for optimizing the printed image quality. In a preferred embodiment of this feature, the irradiated areas are densely arranged, i.e. essentially without irradiation gaps. Thereby, optical devices such as lenses or optical collimators can be used in order to form laser beams in a way more suitable for the laser light sources being arranged without interleaving irradiated areas. Especially by forming laser beams with rectangular cross-sections, the laser beams can be adjusted such that an overall cross-section of a laser beam bundle, comprising a group of neighbouring laser beams, exhibits few or no gaps between the laser beams. In an alternative simplified embodiment of this feature only interleaving irradiated areas transverse to the moving direction are avoided, since interleaving irradiated areas in moving direction may be tolerable.

In a preferred embodiment of the printing apparatus the laser light source arrangement comprises subsets of laser light sources, which are arranged in such a way, that their laser beams irradiate target points along a line transverse to the moving direction. This implies that with each movement of the laser light sources and/or the target object more than one new target point can be irradiated at the same time. This feature may speed up the printing process, since multiple image points may be printed simultaneously. For constructional reasons it can be favorable to arrange the laser light sources as modules, for instance as matrices of laser light sources, where laser light sources are arranged in rows and columns so as to form a rectangular array. Preferably the matrices can be oriented such that the rows of laser light sources are perpendicular to the moving direction and the columns of laser light sources are parallel to the moving direction accordingly. This way laser light sources of a row may take over a single step of irradiation during the stepwise increasing of the energy level of a line of target points, whereas laser light sources of a column may stepwise irradiate a single target point. Thus the system architecture and the controllability of the laser light sources may be simplified and production costs decreased.

The complete laser light source arrangement in turn can comprise a plurality of such laser light source modules, to give a matrix of laser light sources, whereby the columns are arranged parallel to a direction of motion and the rows—given by the laser light source modules—are arranged essentially at right angles to the moving direction. However, the arrangement of the individual laser light sources is not restricted to a rectangular pattern. It may be desirable to use also hexagonal or other tilted arrangements or alternative shapes as well in order to increase the printing resolution by using additional lines for interlacing.

In an advantageous embodiment of the printing apparatus the controlling arrangement is realized in such a way, that at least a first laser light source of the laser light sources is continuously irradiating the target object and at least a second laser light source is individually controlled based on the image data. Thus a target point is "pre-heated" by at least one first laser light source, i.e. the target point is irradiated to an energy level just below a certain level where the modifications appear needed for printing, hence referred to as "energy threshold". The energy threshold depends on the texture of the target object and the applied printing technique. It can be stored in the controlling arrangement. Next at least one second laser light source irradiates the pre-heated target point—based on the image data—across said energy threshold towards the final energy level. Because of pre-heating less optical power supply and therefore also less irradiation time is required from the second laser light source. This may allow for a faster printing process.

This feature also may advantageously be used for applications where the specific properties of the target object do not show a linear response and therefore can be used for pre-heating. Due to the avoidance of temporal thermal diffusion an additional benefit may be good image quality in terms of image sharpness because of the short time of irradiation above the energy threshold. In a further advantageously embodiment of this feature the controlling arrangement is realized in such a way, that the irradiation time of at least one second laser light source is kept as short as possible while still achieving the final energy level. This may avoid smearing out the intensity of the laser beams while the target object and/or the laser light sources are moving. The pre-heating leads to temperatures sub-energy threshold and is therefore less critical. In an alternative embodiment at least a third laser light source of the laser light sources continuously irradiates i.e. post-heats the target object.

Generally it is useful to control laser light sources individually to print an image according to the image data. Now, in an advantageous embodiment of the printing apparatus, the controlling arrangement is realized in such a way that at least one subset of laser light sources is controlled as one, i.e. as a single entity. This means that a single control action of the controlling arrangement affects or controls more then one laser light source in the same way at the same time. As a consequence not all laser light sources have to be addressed separately, which may simplify the addressing and the system architecture. This feature may simplify the pre-heating of target points (see above), since multiple pre-heating laser light sources can be controlled as one. In an advantageous embodiment of this feature laser light sources that are controlled as one can be physically connected to the controlling instance as one, thus simplifying the system design. In a further advantageous embodiment of this feature, laser light sources that irradiate target points transversely to the moving direction may be controlled as one.

There may be cases where the thermal conductivity of the target object is very high or, more generally, where it may be desirable to have at one target point and at one specific time a laser power higher than the maximum output power of single laser light source. Therefore, as an additional means, in an enhanced embodiment of the printing apparatus the laser beam of at least one continuously irradiating laser light source acts to give an optical superposition with the laser beam of at least one individually controlled laser light source at at least one target point. The superimposing laser light sources are mounted in an adequate geometrical arrangement and/or additional lenses are used. In an advantageous embodiment of this feature at least one arrangement of superimposing laser light sources comprises pre-heating laser light sources and "printing laser light sources", i.e. individually controllable laser light sources adding the missing optical power to the final energy level for printing.

In an advantageous embodiment of the printing apparatus at least one of the laser lights sources comprises a Vertical Cavity Surface Emitting Laser (VCSEL). Preferably all laser light sources may comprise VCSELs. Besides being easy to control and very cost-effective, VCSELs provide a comparatively large output aperture. They also produce a comparatively low divergence angle of the output beam and a reduced threshold current, resulting in low power consumption and permitting high intrinsic modulation bandwidths. However, VCSELs still have comparatively low emission power, but this problem is addressed and solved by this invention.

In an advantageous method for controlling such printing apparatus, the heat load is distributed between subsets of individually controllable laser light sources according to defined load distribution rules. For example, if all laser light sources or laser light source modules are of the same type and replaceable at the same cost, the load may be distributed evenly among the laser light sources. Thus, overheating of laser light sources can be avoided. The load distribution rules can be stored in the controlling arrangement.

In a further, advantageous method for controlling such printing apparatus the optical output power levels and/or pulse widths of individually controllable laser light sources are controlled individually according to defined image quality rules. Thereby the image quality rules may be defined in such a way, that the value of the optical output power and/or pulse width is chosen in accordance with the texture of the target object in order to optimize the quality of the printed image e.g. to avoid smearing.

These and other aspects of the invention will be apparent from and elucidated with reference to the embodiment(s) described hereinafter.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

For better understanding of the spatial orientation in the Figures, these include a miniature Cartesian coordinate system at the bottom right.

Figure 1:
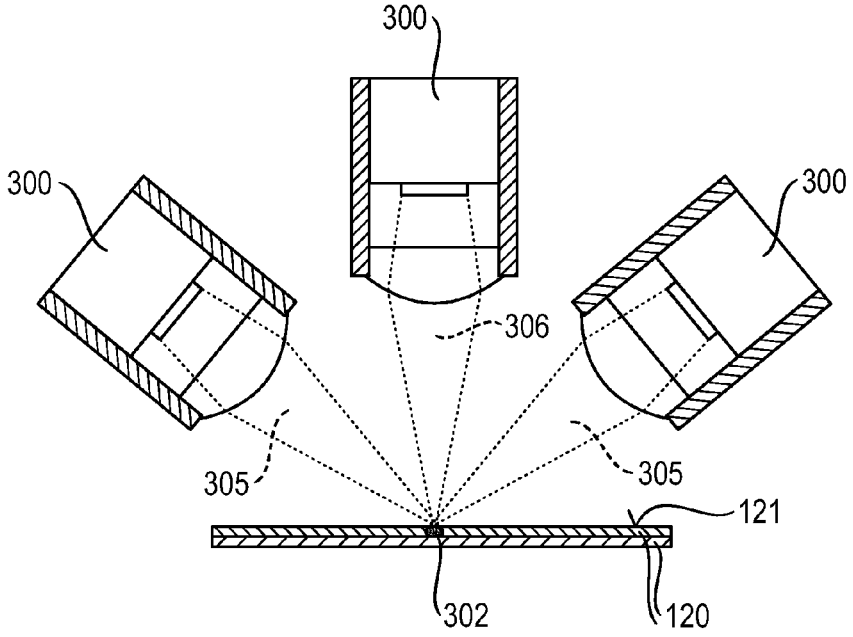
Prior Art FIG. 1
FIG. 1 is a schematic representation of a prior art solution with optical superposition only.

FIG. 1 is a schematic representation of a prior art solution with optical superposition only. Three laser light sources 300 are arranged such that their laser beams 305, 306 are superimposing at one target point 302 on a surface 121 of a target object 120. Thus the power density at that target point 302 can be approximately three times as high as the power density of each single laser beam. This might help to overcome the shortcomings of laser light sources with low power density like VCSELs. But this approach requires a specific geometrical arrangement of the laser light sources as shown in FIG. 1 and/or the use of additional lenses, which implicates a significantly more complex and therefore less cost-effective system architecture. Furthermore it becomes clear from FIG. 1 that geometrical restrictions limit the number of lasers beams, which can be superimposed. Also the general limitation in terms of solid angles and Etendue is well known. In addition lasers beams coming from the sides 305 have non-perpendicular incidence and therefore can be absorbed differently and can show a distorted illumination pattern.

Figure 2:
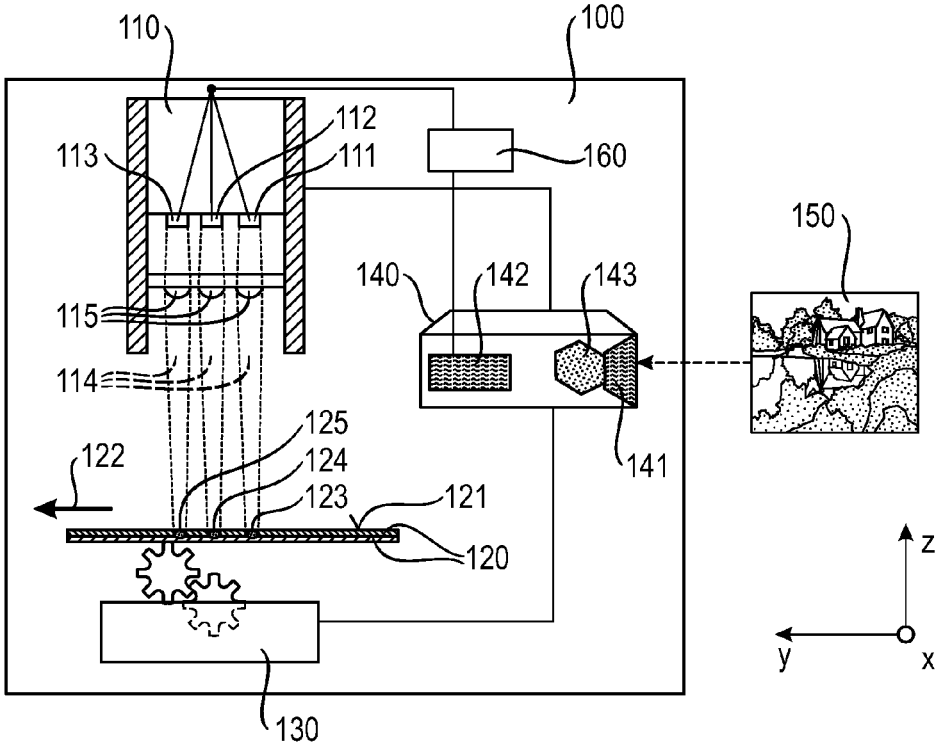
FIG. 2 schematically shows an embodiment of a printing apparatus according to the invention.

FIG. 2 schematically shows an embodiment of a printing apparatus 100 according to the invention. Depicted is direct printing, i.e. printing onto the final printing medium. The printing apparatus 100 comprises a laser light source arrangement 110, a transport mechanism 130 and a controlling arrangement 140 electrically connected to the laser light source arrangement 110 and the transport mechanism 130. The transport mechanism 130 moves a target object 120 in a moving direction 122 to a proper position for irradiation by the laser light sources 111, 112, 113. The motion mechanics of the transport mechanism 130 is realized in such a way, that precision and accuracy of the movement are adequate for the desired printing resolution and image quality. Here the target object 120 is also the final printing medium, i.e. a plane paper with a special surface 121 suitable for laser light printing. The transport mechanism 130, here only depicted schematically, can be realized for example by means of a transfer roller.

The laser light source arrangement 110 comprises three subsets of multiple laser light sources in the form of rows arranged in x-direction. Thereby, three laser light sources, one of each row, form a laser light source column parallel to the moving direction 122. One laser light source column 111, 112, 113 is explicitly depicted in FIG. 2. The remaining laser light source columns of the arrangement, not explicitly shown in FIG. 2, are working according to the same principle. To avoid gaps in the optical power output in x-direction, the laser light sources may be mounted in close proximity. Here, the laser light sources are cost-effective and simply controllable semiconductor laser diodes, namely Vertical Cavity Surface Emitting Lasers VCSELs, but other kinds of laser light sources may be applied as well. Each row of laser light sources may be constructed as a sub-module with an independent cabling in such a way, that each sub-module can be exchanged easily in order to simplify maintenance and repair. Also neighboring laser light rows may be positioned close together, for example on a printed circuit board, building a laser light source module. Neighbouring laser rows may also be build monolithically on one and the same semiconductor chip.

The laser beams 114 emitted by the laser light sources 111, 112, 113 are focused onto to the surface 121 of the target object 120 by means of microlenses 115. The output of a typical semiconductor laser like a VCSEL, due to its small diameter, diverges almost as soon as it leaves the aperture, at an angle of anything up to 50°. However, such a divergent beam can be transformed into a focussed beam by means of a lens. Dependent on the printing application e.g. printing on packages, offset plate writing or laser sintering, the laser light sources 111, 112, 113 are irradiating different kinds of target surfaces. Thereby different physical effects are produced on each kind of target surface, e.g. change of the electrical property or melting of small particles of powdered material like plastic, metal, ceramic or glass. Therefore the laser light sources are mounted according to their physical properties in a proper position to the target surface 121 such that effective irradiation of the target object with adequate resolution can be assured.

The controlling arrangement 140 comprises an image data interface 141, an image data converter 143 and a power control module 142. The power control module 142 controls the power supply 160 of the laser light sources. The power supply supplies electrical or other types of energy to the laser light sources. In FIG. 2 the power supply is shown as one module, but in reality there can be different power supplies for each individually controlled laser light source. Groups of continuously irradiating laser light sources, which require the same power can share a single power supply. It may be advantageous that the power control module provides power regulation within a range from zero to maximum power. But in order to keep the system simple binary on-off regulation can be considered as well. The controlling arrangement 140 controls the transport mechanism 130 to move the target object 120 in moving direction 122. FIG. 2 depicts one target point 123, 124, 125 at three different stages during the printing process. Thereby the target point 123, 124, 125 passes the focus of the laser beam 114 of the three affected laser light sources 111, 112, 113 one after the other. Here, the target point 123, 124, 125 is also the image point, since printing onto the final printing medium is depicted. As soon as the target point passes an affected laser light source, based on image data 150 the power control module 142 drives the power supply (160) of that laser light source to supply optical power to that target point according to a defined control algorithm. The first laser light source 111 of the laser light source column irradiates the target point first, the second laser light source 112 irradiates the target point second and the third laser light source 113 irradiates the target point last. This way the energy level of the target point is increased within three steps to a desired level adequate for printing the image. The control algorithm can be stored in the controlling arrangement 140.

The controlling arrangement 140 of the printing apparatus 100 gets image data 150 via the image data interface 141 encoded in one or any number of special description languages or formats, e.g. CAD files, Adobe PostScript, text-only data or bitmaps. The image data converter 143 transforms the image data 150 into an internal printing format suitable for the controlling arrangement to control the laser light sources adequately. Alternatively the transforming may be done prior to the printing process by some external background system; in other words, the controlling arrangement can also receive image data already in internal printing format without using the image data converter 143 at all.

Figure 3:
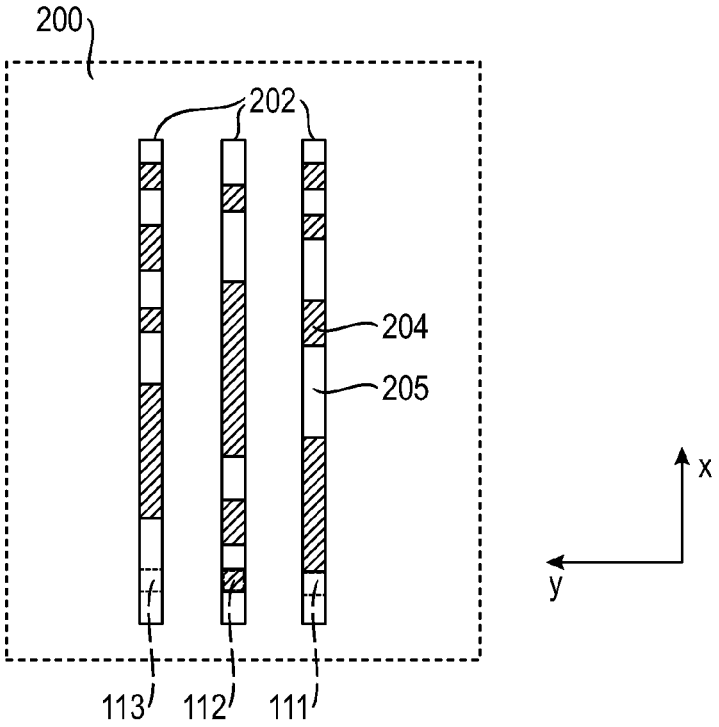
FIG. 3 shows an intensity profile generated by the printing apparatus depicted in FIG. 2.

FIG. 3 shows an example of an intensity profile 200 generated by the laser light source arrangement 110 of the printing apparatus 100 depicted in FIG. 2 during the printing process. It illustrates how the controlling arrangement 140 via the power control module 142 controls the laser light sources to irradiate the target surface 121 based on the image data 150. The intensity profile comprises three bars of black and white areas 202 in x-direction relating to the three rows of laser light sources 111, 112, 113 of the laser light source arrangement 110. The white areas 205 show where laser light sources of the laser light source arrangement are not supplying any optical output power onto the target surface 121 at that moment. The black areas show where laser light sources of the laser light source arrangement 110 is supplying full optical output power onto the target surface 121 at that moment. It can be seen from the intensity profile 200 that in this embodiment all rows of the laser light source arrangement 110 comprise individually controlled laser light sources 111, 112, 113. Thus the final energy level of the printed image line is determined by the total amount of the optical output power of all of the three rows of laser light sources 111, 112, 113 according to their depicted intensity profiles.

Figure 4:
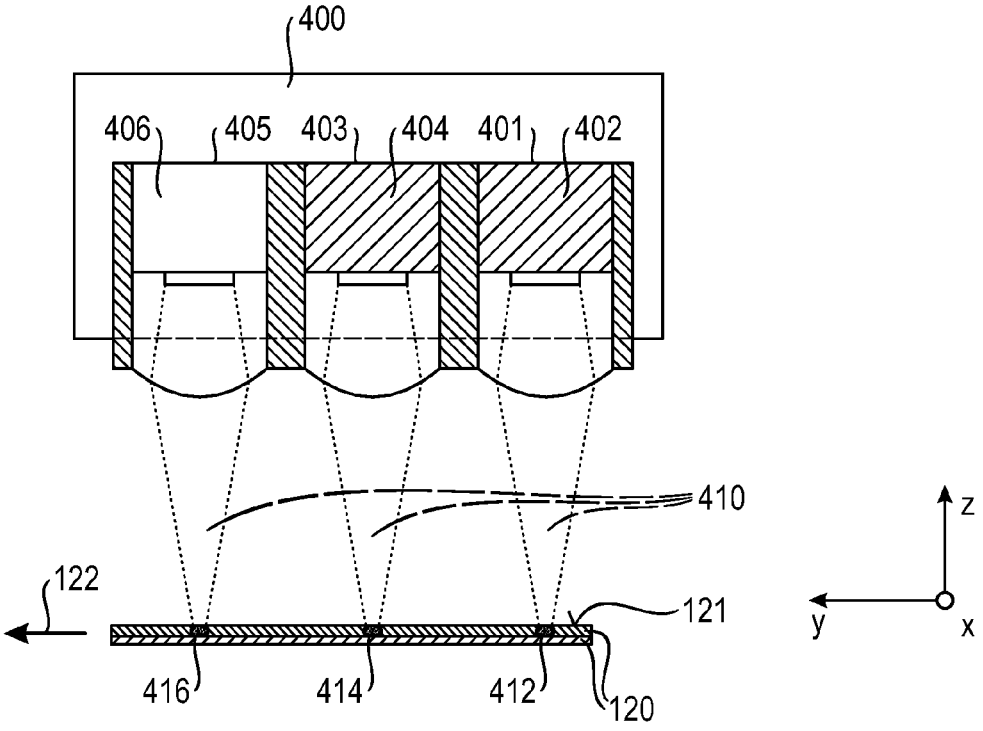
FIG. 4 schematically shows a laser light source arrangement for printing with pre-heating.
Figure 5:
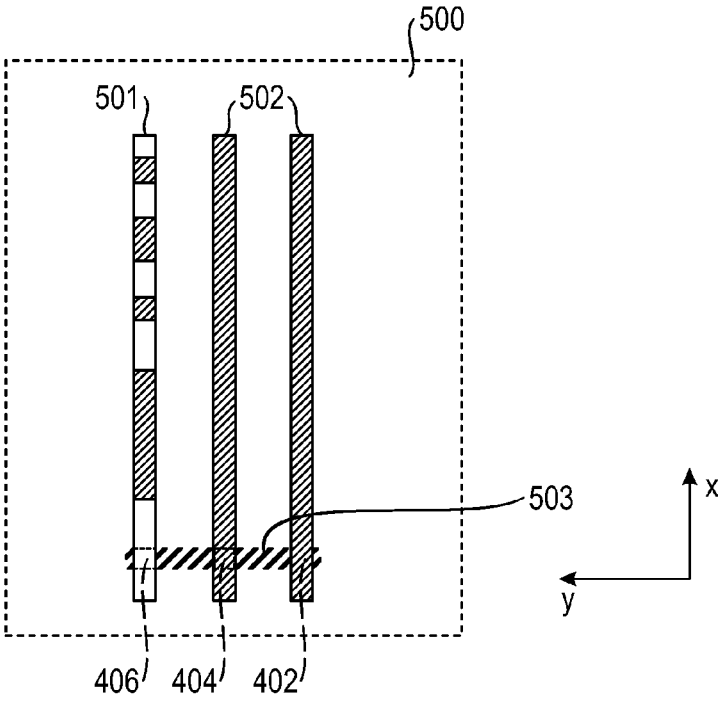
FIG. 5 shows an intensity profile generated by the laser light source arrangement depicted in FIG. 4.

FIG. 4 schematically shows a laser light source arrangement 400 of an embodiment of a printing apparatus according to FIG. 2 for printing with pre-heating and FIG. 5 shows an exemplary intensity profile 500 generated by that laser light source arrangement 400. The laser light source arrangement 400 comprises three subsets of multiple laser light sources in the form of rows 401, 403, 405 arranged in x-direction. Three laser light sources 402, 404, 406, one of each row, form a laser light source column 503 parallel to the moving direction 122. The remaining laser light source columns, not explicitly shown in FIG. 4, are working according to the same principle. The last laser light source 406 of the laser light source column 503 is individually controllable according to the image data 150, i.e. it is a "printing laser light source". The first 402 and second 404 laser light sources are pre-heating the surface 121 of the target object 120. The rows of pre-heating laser light sources 402, 404 are controlled as one single entity or as separate lines, since they act the same way, i.e. they are providing the same output power at the same time, thus simplifying the controlling and the system architecture. During the printing process the target object is moved in y-direction 122 and each target point 412, 414, 416 is passing the focus of each laser beam 410 of the three laser light sources 402, 404, 406 one after the other. FIG. 4 depicts one target point 412, 414, 416 at three different stages during the printing process. Thereby the first laser light source 402 is taking on the first step of pre-heating the target point 412, 414, 416 and the second laser light source 404 is taking on the second step of pre-heating the target point 412, 414, 416. Finally the last laser light source 406 is printing the image point, i.e. it irradiates the target point 412, 414, 416 across the energy threshold to the final energy level based on the image data 150. Thus it is the row 405 of printing laser light sources 406, which determines the final target image. The pre-heating is carried out such that the laser light source 404 doing the second step of pre-heating is irradiating the target point 412, 414, 416 again in time before cooling and thermal diffusion of the target surface 121 decreases the energy level of the target point 412, 414, 416 significantly.

The intensity profile 500 shown in FIG. 5 is represented the same way as in FIG. 3. The target object 120 is moved in y-direction. In comparison to the intensity profile 200 depicted in FIG. 3 in FIG. 5 the intensity profile 500 shows two completely black bars 502, representing the two rows 401, 403 of pre-heating laser light sources 402, 404 of the laser light source arrangement 400 in FIG. 4. Thus the final energy level of the printed image line is determined by the total amount of the optical output power of the two rows 401, 403 of pre-heating laser light sources 402, 404 and the row 405 of printing laser light sources 406 according to their depicted intensity profiles.

Figure 6:
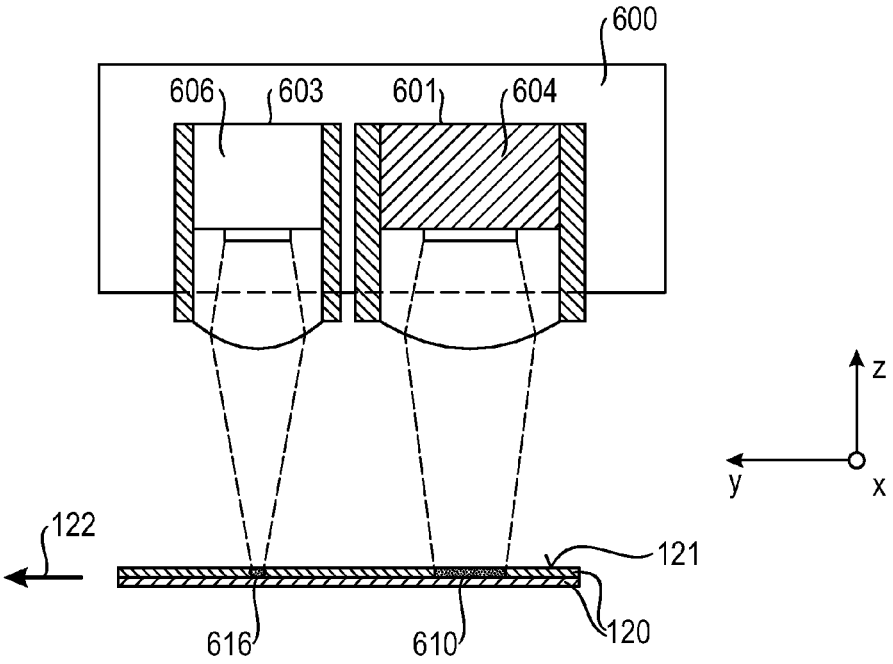
FIG. 6 schematically shows an alternative laser light source arrangement for printing with pre-heating.
Figure 7:
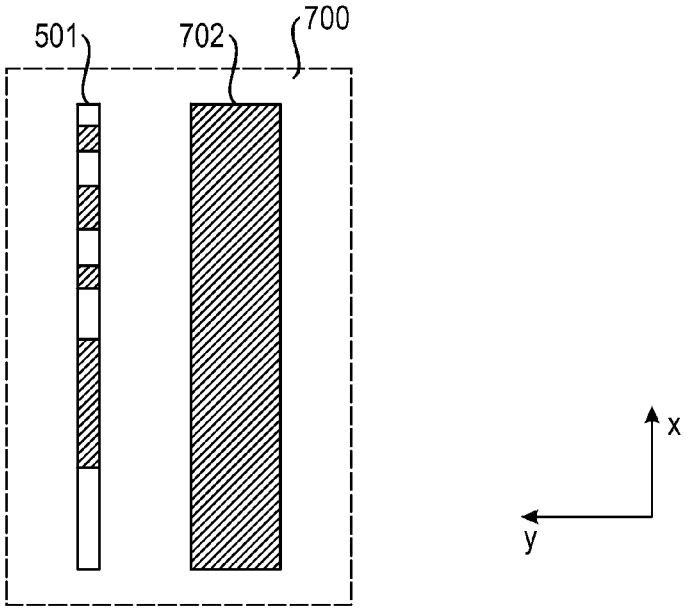
FIG. 7 shows an intensity profile generated by the laser light source arrangement depicted in FIG. 6.

FIG. 6 schematically shows an alternative embodiment to the laser light source arrangement 400 depicted in FIG. 4 and FIG. 7 shows an exemplary intensity profile 700 generated by that laser light source arrangement 600. Compared to the laser light source arrangement 400 in FIG. 4, this laser light source arrangement 600 comprises one row 601 of larger area pre-heating laser light sources 604 instead of two rows 401, 403 of smaller pre-heating laser light sources 402, 404. Larger area laser light sources may advantageously replace multiple smaller laser light sources when it comes to pre-heating. Pre-heating is about increasing the energy level of an area 610 of the target surface 121 rather than to irradiate a target point 612. Using larger area laser light sources 604 for pre-heating may simplify the system architecture and therefore be more cost-effective, since less laser light sources may be needed for each laser light source arrangement 600 altogether. Analogous to the laser light source arrangement 400 depicted in FIG. 4 the last laser light source 606 in y-direction is a printing laser light source, i.e. it irradiates a target point 616 across the energy threshold according to the image data 150.

The intensity profile 700 shown in FIG. 7 is represented the same way as in FIG. 3. The target object 120 is moved in y-direction. In comparison to the intensity profile 500 depicted in FIG. 5 in FIG. 7 the intensity profile 700 shows one broader completely black bar 702 instead of the two narrow ones 502 depicted in FIG. 5. The broad black bar 702 is representing the row 601 of pre-heating larger area laser light sources 604 of the laser light source arrangement 600 in FIG. 6. Thus according to this intensity profile 700 the laser light source arrangement 600 is pre-heating one broad area for further printing and prints one line of image data 150 onto the target surface.

Figure 8:
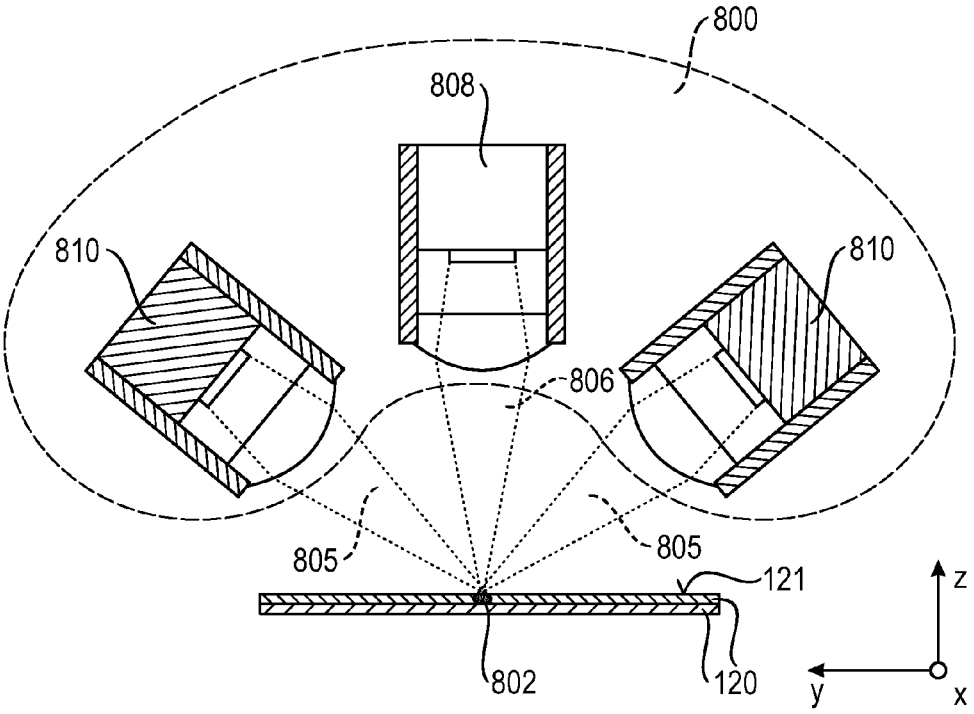
FIG. 8 schematically shows an alternative laser light source arrangement with optical superposition and pre-heating.

FIG. 8 schematically shows a sub-module of laser light sources 800 with optical superposition and "offset-heating", i.e. basic heating independent from image data 150. The sub-module may replace single printing laser light sources within the laser light source arrangements 110, 400, 600 of FIG. 1, FIG. 4 or FIG. 6. Instead of one laser light source of a laser light source row, three laser light sources 808, 810—or three rows of such light sources 808, 810—are arranged in a sub-module 800 such that their laser beams 805, 806 are superimposing at one target point 802 on a surface 121 of a target object 120. One central laser light source 808 irradiating the target surface 121 perpendicularly is used as the printing laser light source. The two tilted laser light sources 810 arranged on both sides of the central laser light source 808, are simultaneously offset-heating the target surface 121. Since the two tilted laser light sources 810 are only offset-heating and not "printing", the problem of producing a distorted illumination pattern according to a non-perpendicular incidence angle as discussed in FIG. 1 is not relevant here.

Figure 9A:
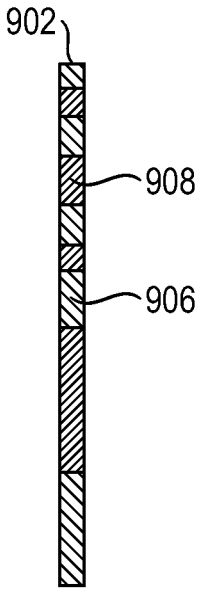
FIGS. 9*a* and 9*b* show two alternative intensity profiles generated by a row of laser light source arrangements as depicted in FIG. 8.
Figure 9B:
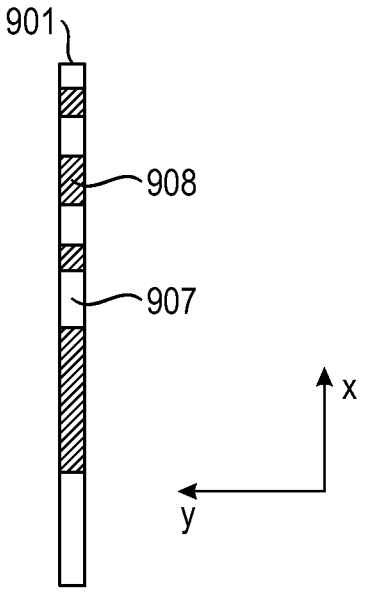

FIG. 9*a* and FIG. 9*b* show two exemplary intensity profiles 901, 902 generated during printing with pre-heating by a row of laser light sub-modules 800 as depicted in FIG. 8, which is extending in x-direction. The intensity profiles 900, 910 are represented the same way as in FIG. 2. The intensity profile of FIG. 9*a* is generated by a row of laser light sub-modules 800 according to FIG. 8 with tilted offset-heating laser light sources 810. Thereby the controlling arrangement 140 is switching on all tilted offset-heating laser light sources 810 of the row. Thus areas of the target surface 121 though not irradiated by printing laser light sources are offset-heated nevertheless. Accordingly the relating intensity profile in FIG. 9*a* shows also grey areas 906, which illustrate that just offset-heating below the energy threshold takes place without final printing. This may have advantages in simplicity of the system architecture and therefore costs.

Alternatively FIG. 9*b* illustrates an intensity profile generated by a row of laser light sub-modules 800 with two rows of tilted individually controlled laser light sources, instead of the two rows of tilted offset-heating laser light sources 810 depicted in FIG. 8. Thereby the controlling arrangement 140 is addressing only such tilted laser light sources that support printing laser light sources 808 irradiating a target point. Thus areas of the target surface 121 not irradiated by printing laser light sources 808 are not offset-heated. This can be derived from the intensity profile in FIG. 9*b*, which shows either white areas 907 without activity or black areas 908 with full optical power output of all three laser light sources. This approach is more energy efficient, because only areas are irradiated where needed.

For the sake of clarity, it is to be understood that the use of "a" or "an" throughout this application does not exclude a plurality, and use of the word "comprising" does not exclude other steps or elements. A "unit" or "module" can comprise a plurality of units or modules, respectively. The mere fact that certain measures are recited in mutually different dependent claims does not indicate that a combination of these measures cannot be used to advantage.

The control of the printing apparatus in accordance with the method of controlling the printing apparatus can be implemented as program code means of a computer program and/or as dedicated hardware.

A computer program may be stored/distributed on a suitable medium, such as an optical storage medium or a solid-state medium, supplied together with or as part of other hardware, but may also be distributed in other forms, such as via the Internet or other wired or wireless telecommunication systems.

Any reference signs in the claims should not be construed as limiting the scope.

The invention claimed is:

1. A printing apparatus using laser light sources for supplying energy to a target object to form an image, comprising a laser light source arrangement comprising a plurality of laser light sources arranged such that laser beams of the laser light sources intersect a surface of a target object at different target points along a moving direction, a transport mechanism for moving at least one of the target object and the laser light sources relative to each other in the moving direction, wherein with each movement of the at least one of the laser light sources and the target object a selected one of the different target point is irradiated by at least one of the plurality of laser light sources, wherein multiple target points can be printed simultaneously, and a controlling arrangement configured to:

control the plurality of laser light sources based on data associated with the image wherein an energy level at the selected target point is stepwise increased by irradiation of at least two different laser light sources along the moving direction, wherein the laser light sources are operated at a defined power operating point dependent upon a texture of the target object.

2. The printing apparatus according to claim 1, wherein the controlling arrangement wherein controlling of the laser light sources is synchronised with the movement of the target object.

3. The printing apparatus according to claim 1, wherein the controlling arrangement is configured to individually control a subset of the laser light sources based on the data associated with the image.

4. The printing apparatus according to claim 1, wherein the transport mechanism moves the target object and the laser light sources relative to each other wherein each laser light source is irradiating the selected target point only once.

5. The printing apparatus according to claim 1, wherein the power operating point being a fraction of a maximum output power of the laser light sources.

6. The printing apparatus according to claim 1, wherein the laser light source arrangement comprises subsets of laser light sources, wherein corresponding laser beams of the subsets of laser light sources irradiate target points transversely to the moving direction.

7. The printing apparatus according to claim 1, wherein at least one subset of the laser light sources is controlled as a single entity.

8. The printing apparatus according to claim 1, wherein at least a first laser light source continuously irradiates the selected target point and at least a second laser light source is individually controlled based on the image data to irradiate the selected target point.

9. The printing apparatus according to claim 1, wherein a laser beam of at least one continuously irradiating laser light source is optically superimposed with a laser beam of at least one individually controlled laser light source at the selected target point.

10. The printing apparatus according to claim 1, wherein at least one of the laser light sources comprises a VCSEL.

11. A method of controlling a printing apparatus using laser light sources for supplying energy to a target object to form an image, comprising moving at least one of the target object and the laser light sources relative to each other wherein laser beams of the laser light sources intersect a surface of the target object at different target points along a moving direction, wherein with each movement of at least one of the laser light sources and the target object more than one target point is irradiated at a same time such that multiple printing image points can be printed simultaneously, regulating an irradiation intensity of a selected target point in accordance with the motion of at least one of the target object and the laser light sources, wherein an energy level at the selected target point is stepwise increased by irradiation of at least two different laser light sources along the moving direction based on data associated with the image, wherein the laser light sources are operated at a defined power operating point dependent upon a texture of the target object.

12. The method of controlling a printing apparatus according to claim 11, wherein at least a first laser light source is continuously irradiating the target object and at least a second laser light source is individually controlled based on the image data.

13. The method of controlling a printing apparatus according to claim 11, wherein a heat load at the selected target point is distributed between subsets of individually controllable laser light sources according to defined load distribution rules.

14. The method of controlling a printing apparatus according to claim 11, wherein missing output power of failing one of the laser light sources is compensated by other laser light sources, which are irradiating the same selected target point at an increased output power according to defined compensation rules.

15. The method of controlling a printing apparatus according claim 11, wherein at least one of a power level and a pulse width of individually controllable laser light sources are controlled individually according to defined image quality rules.

* * * * *